US007047945B2

(12) United States Patent
Ishii et al.

(10) Patent No.: US 7,047,945 B2
(45) Date of Patent: May 23, 2006

(54) START-UP CONTROL OF IN-CYLINDER FUEL INJECTION INTERNAL COMBUSTION ENGINE

(75) Inventors: Hitoshi Ishii, Yokosuka (JP); Masahiko Yuya, Yokohama (JP); Tsutomu Kikuchi, Tokyo (JP); Yuichi Iriya, Yokohama (JP); Mitsuhiro Akagi, Yokohama (JP); Masahiro Fukuzumi, Machida (JP); Katsuaki Uchiyama, Yokohama (JP); Takao Maitani, Isehara (JP); Masayuki Tomita, Yokohama (JP); Yoshinao Ugomori, West Bloomfield, MI (US)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/901,378

(22) Filed: Jul. 29, 2004

(65) Prior Publication Data

US 2005/0039726 A1 Feb. 24, 2005

(30) Foreign Application Priority Data

Jul. 30, 2003 (JP) ..... 2003-203835

(51) Int. Cl.
*F02B 3/00* (2006.01)
*F02M 51/00* (2006.01)
*F02D 41/04* (2006.01)

(52) U.S. Cl. ..... 123/491; 123/295; 123/299

(58) Field of Classification Search ..... 123/295, 123/299, 300, 305, 478, 480, 491; 701/104, 701/105, 113
See application file for complete search history.

(56) References Cited

U.S. PATENT DOCUMENTS

| | | | | |
|---|---|---|---|---|
| 5,785,031 | A * | 7/1998 | Akimoto et al. | 123/295 |
| 6,145,490 | A * | 11/2000 | Heidenfelder et al. | 123/295 |
| 6,216,664 | B1 * | 4/2001 | Bochum et al. | 123/305 |
| 6,439,190 | B1 * | 8/2002 | Bochum | 123/295 |
| 6,505,602 | B1 * | 1/2003 | Mezger et al. | 123/295 |
| 6,553,959 | B1 * | 4/2003 | Xu et al. | 123/295 |
| 6,899,077 | B1 * | 5/2005 | Wagner et al. | 123/295 |

FOREIGN PATENT DOCUMENTS

JP 10-103117 A 4/1998

* cited by examiner

*Primary Examiner*—Willis R. Wolfe, Jr.
(74) *Attorney, Agent, or Firm*—Foley & Lardner LLP

(57) ABSTRACT

A four-stroke cycle in-cylinder fuel injection internal combustion engine (1) comprises a fuel injector (8) which injects fuel directly into a combustion chamber (7), performs stratified charge combustion by means of compression stroke fuel injection, and performs homogeneous combustion by means of intake stroke fuel injection. Upon start-up of the engine (1), intake stroke fuel injection is performed at the first combustion opportunity, and compression stroke fuel injection is switched to from the second combustion opportunity onward. In so doing, switching of the combustion system is performed early and independently of the engine rotation speed.

11 Claims, 4 Drawing Sheets

STARTER SWITCH
ON

HIGH
C
Pf
0

HIGH
Ne
B
0

COMPRESSION STROKE FUEL INJECTION FLAG
1
0
INTAKE STROKE FUEL INJECTION IN INITIAL COMBUSTION CYCLE
COMPRESSION STROKE FUEL INJECTION
t1
t2
t3 t4
LARGE
TIME

START-UP CONTROL OF IN-CYLINDER FUEL INJECTION INTERNAL COMBUSTION ENGINE

FIELD OF THE INVENTION

This invention relates to fuel injection control during start-up of a spark ignition internal combustion engine in which fuel is injected directly into a combustion chamber of a cylinder.

BACKGROUND OF THE INVENTION

Tokkai Hei10-103117, published by the Japan Patent Office in 1998, proposes that in an in-cylinder fuel injection four-stroke cycle internal combustion engine, homogeneous combustion, whereby fuel is injected in the intake stroke, be performed in the period from the beginning of cranking during start-up to the point at which the engine rotation speed reaches a fixed speed, and that stratified charge combustion, whereby fuel is injected in the compression stroke, be performed thereafter.

SUMMARY OF THE INVENTION

During a cold start of an internal combustion engine, beginning compression stroke fuel injection early, such that stratified charge combustion is performed at an air-fuel ratio in the vicinity of the stoichiometric air-fuel ratio, is preferable for reducing the amount of hydrocarbon (HC) discharge. When stratified charge combustion is performed by means of compression stroke fuel injection, it is easier to generate after-burning than when homogeneous combustion is performed by means of intake stroke fuel injection. After-burning promotes the combustion of HC, which is unburned fuel.

However, when comparing stratified charge combustion by means of compression stroke fuel injection and homogeneous combustion by means of intake stroke fuel injection, homogeneous combustion by means of intake stroke fuel injection generates greater torque and stronger engine rotation torque in relation to the same amount of fuel injection. It is therefore more beneficial to perform homogeneous combustion by means of intake stroke fuel injection than stratified charge combustion by means of compression stroke fuel injection from the build-up of the engine rotation speed following cranking.

In the prior art, switching from homogeneous combustion by means of intake stroke fuel injection to stratified charge combustion by means of compression stroke fuel injection is performed on the condition that the engine rotation speed exceeds a set rotation speed. The set rotation speed is set at a level that is equal to or greater than a cranking rotation speed and lower than an idling rotation speed.

However, the engine rotation speed varies greatly during start-up, and moreover, unevenness in the rotation speed is great at low rotation speeds. It is therefore difficult to grasp the engine rotation speed during start-up accurately. In the prior art, where switching of the fuel injection timing is dependent on the engine rotation speed, it is difficult to expedite the switching timing.

It is therefore an object of this invention to perform switching from homogeneous combustion by means of intake stroke fuel injection to stratified charge combustion by means of compression stroke fuel injection early.

In order to achieve the above object, this invention provides a start-up fuel injection control device for an in-cylinder fuel injection internal combustion engine which operates on a four-stroke cycle comprising an intake stroke, a compression stroke, an expansion stroke, and an exhaust stroke. The engine comprises a fuel injector which injects fuel directly into a combustion chamber and performs stratified charge combustion, in which the fuel injector injects fuel in the compression stroke, and homogeneous combustion, in which the fuel injector injects fuel in the intake stroke.

The start-up fuel injection control device comprises a programmable controller programmed to control the fuel injector to perform fuel injection for an initial combustion in the intake stroke, and to perform fuel injection for a second combustion onward in the compression stroke.

This Invention also provides a start-up fuel injection control method for the same engine, comprising controlling the fuel injector to perform fuel injection for an initial combustion in the intake stroke, and to perform fuel injection for a second combustion onward in the compression stroke.

The details as well as other features and advantages of this invention are set forth in the remainder of the specification and are shown in the accompanying drawings.

DESCRIPTION OF THE PREFERRED EMBODIMENTS

Figure 1:
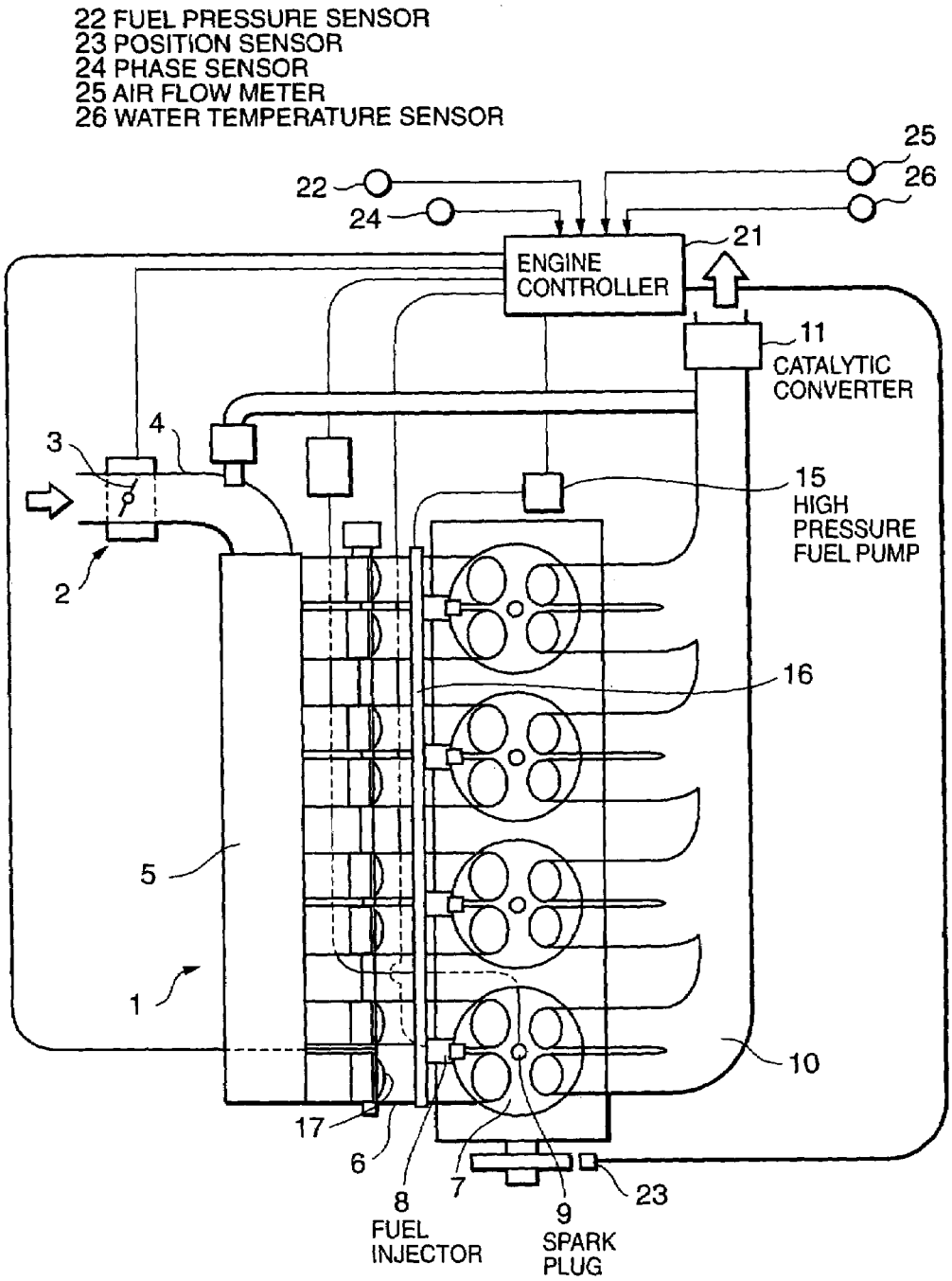
FIG. 1 is a schematic diagram of a start-up fuel injection control device for an in-cylinder fuel injection internal combustion engine according to this invention.

Referring to FIG. 1 of the drawings, an in-cylinder fuel injection spark ignition internal combustion engine 1 for use in a vehicle is constituted by a four-stroke cycle, water-cooled, four-cylinder gasoline engine in which an intake stroke, a compression stroke, an expansion stroke, and an exhaust stroke are repeated in succession.

The internal combustion engine 1 comprises four combustion chambers 7. Air is aspirated into each combustion chamber 7 from an intake manifold 6. The intake manifold 6 is connected to an intake passage 4 via a collector 5. The intake passage 4 comprises an electronic throttle 3 which regulates the amount of intake air. The internal combustion engine 1 comprises a fuel injector 8 and a spark plug 9 which face the combustion chamber 7. High-pressure fuel is supplied to the fuel injector 8 from a high pressure fuel pump 15 through a common rail 16. The common rail 16 functions as an accumulator for storing the high-pressure fuel discharged by the high pressure fuel pump 15 temporarily while maintaining the pressure thereof. Fuel that is subject to pressurization by the high pressure fuel pump 15 is supplied from a fuel tank through a low pressure pump. The high pressure fuel pump 15 is constituted by a single cylinder plunger pump which is driven by the internal combustion engine 1.

Fuel injected into the combustion chamber 7 by the fuel injector 8 mixes with air aspirated from the intake manifold 6 to form an air-fuel mixture which is burned when the spark plug 9 ignites. Combustion gas is discharged into the atmosphere from an exhaust manifold 10 via a catalytic converter 11. The catalytic converter is constituted by a three-way catalyst and a nitrogen oxide (NOx) trapping catalyst.

It should be noted that an intake valve is provided between the combustion chamber 7 and the intake manifold 6, and an exhaust valve is provided between the combustion chamber 7 and the exhaust manifold 10, but since the functions and operations of these valves bear no relation to this invention, they have been omitted from FIG. 1.

A tumble control valve 17 is provided on the intake manifold 6. When the tumble control valve 17 is closed, tumble, or vertical swirl, is generated by the intake air in the combustion chamber 7. As a result of the interaction between the tumble and a cavity formed at the crown of the piston, the fuel injected by the fuel injector 8 in the compression stroke mixes with the intake air, thus producing an air-fuel mixture with a high fuel concentration about the spark plug 9 and an air-fuel mixture with a low fuel concentration on the outside thereof. The generation of a stratified air-fuel mixture using this method is known as an air guide system. When the spark plug 9 ignites the stratified air-fuel mixture, so-called stratified combustion is performed.

On the other hand, when intake stroke fuel injection is performed with the tumble control valve 17 open, the injected fuel diffuses through the combustion chamber 7 uniformly. When the spark plug 9 ignites the air-fuel mixture in this condition, so-called homogeneous combustion is performed.

The fuel injector 8 injects fuel for a period corresponding to the length of the pulse of an injection pulse signal at a timing which corresponds to the output of this signal from an engine controller 21. The fuel injection amount of the fuel injector 8 is commensurate with the injection period of the fuel injector 8 and the fuel pressure in the common rail 16. The discharge amount from the high pressure fuel pump 15 is controlled by a signal that is output from the engine controller 21.

The fuel pressure that is required in the common rail 16 varies according to the engine load and engine rotation speed of the internal combustion engine 1. When the engine load is constant, a higher fuel pressure is required as the engine rotation speed increases. When the engine rotation speed is constant, a higher fuel pressure is required as the engine load increases. The required fuel pressure varies within a wide range having a minimum value of approximately 0.5 megapascals (MPa) and a maximum value of approximately 11 MPa.

If the required fuel pressure is assumed to be a constant value, then variation in the required fuel injection amount must be accommodated by the injection period of the fuel injector 8 alone. In this case, requirements regarding the specifications of the fuel injector 8 become strict. However, the required fuel injection amount can be satisfied by varying the fuel pressure in accordance with the engine load and engine rotation speed without greatly varying the injection period of the fuel injector 8.

The high pressure fuel pump 15 comprises in its interior a return passage which recirculates discharged fuel into the fuel tank, and an electromagnetic control valve which regulates the flow rate of the return passage in accordance with a duty signal.

Next, a start-up fuel injection control device of the in-cylinder fuel injection spark ignition internal combustion engine 1 will be described. Start-up of the internal combustion engine 1 is performed similarly to a normal vehicle engine by cranking using a starter motor.Å@A starter switch starts and stops the operation of the starter motor.

The start-up fuel injection control device comprises the engine controller 21 which controls the fuel injection timing and injection amount of the fuel injector 8, the fuel pressure of the common rail 16 and the opening/closing of the tumble control valve 17 during start-up of the internal combustion engine 1. As shown in the drawings, the engine controller 21 not only controls fuel injection during start-up, but also controls general operations of the internal combustion engine 1, including the ignition timing of the spark plug 9 and the opening of the electronic throttle 3. Here, however, description will be limited to control performed during start-up.

The engine controller 21 is constituted by a microcomputer comprising a central processing unit (CPU), read-only memory (ROM), random access memory (RAM), and an input/output interface (I/O interface). The engine controller 21 may be constituted by a plurality of microcomputers.

As parameters for performing fuel injection control during start-up, detection data from a fuel pressure sensor 22 which detects a fuel pressure Pf in the common rail 16, a position sensor 23 which outputs a POS signal each time the internal combustion engine 1 rotates by a fixed angle, a phase sensor 24 which outputs a PHASE signal corresponding to the specific stroke position of each combustion chamber 7 of the internal combustion engine 1, an air flow meter 25 which detects the amount of intake air in the intake passage 4, and a water temperature sensor 26 which detects a cooling water temperature Tw in the internal combustion engine 1 are input respectively into the engine controller 21 as signals. The PHASE signal output by the phase sensor 24 is also used as a signal indicating the engine rotation speed Ne.

On the basis of these signals, the engine controller 21 calculates the width of a start-up fuel injection pulse based on a target air-fuel ratio that is close to the stoichiometric air-fuel ratio during start-up of the internal combustion engine 1. With the tumble control valve 17 closed, the engine controller 21 outputs a signal corresponding to the start-up fuel injection pulse width to the fuel injector 8 during the compression stroke of each cylinder, and thus implements compression stroke fuel injection. The timing of compression stroke fuel injection in each cylinder is determined by the engine controller 21 from the PHASE signal that is output by the phase sensor 24 and the POS signal that is output by the position sensor 23.

The engine controller 21 also increases and decreases the flow rate of the return passage by outputting a duty signal to the electromagnetic control valve of the high pressure fuel pump 15 on the basis of the detected pressure of the fuel pressure sensor 22, and in so doing feedback-controls the fuel pressure in the common rail 16 to a target pressure.

In an initial combustion cycle during start-up of the engine 1, the fuel injection control device performs homogeneous combustion by means of intake stroke fuel injection, and once the increase in the engine rotation speed has gained momentum from the initial combustion, stratified charge combustion by means of compression stroke fuel injection is performed from the second combustion cycle.

In a four-cylinder engine in which the ignition sequence is #1–#3–#4–#2, for example, the initial combustion cycle indicates the period up to the completion of an initial fuel injection in all of the cylinders #1, #3, #4, #2.

FIGS. 2A–2D illustrate variation in the starter switch, the fuel pressure Pf in the common rail 16, and the engine rotation speed Ne from start-up of the engine 1.

When the starter switch switches from OFF to ON at a time t1, cranking of the engine 1 is begun by driving the starter motor, and the engine rotation speed Ne begins to rise. As a result of this increase in the engine rotation speed Ne, the high pressure fuel pump 15 begins to work, causing the fuel pressure Pf in the common rail 16 to rise. Meanwhile, the POS signal and PHASE signal are input into the engine controller 21, and at a time t2, the engine controller 21 performs an initial cylinder discrimination.

During one cycle from the initial cylinder discrimination, or in other words the initial combustion cycle, the engine, controller 21 causes the fuel injector 21 of each of the cylinders #1, #3, #4, #2 to perform intake stroke fuel injection, and thus homogeneous combustion is performed in each of the cylinders #1, #3, #4, #2.

When the final fuel injection of the initial combustion cycle is complete, the engine controller 21 switches the fuel injection timing of the fuel injector 21 of each cylinder #1, #3, #4, #2 to compression stroke fuel injection, and thus switches the combustion method from homogeneous combustion to stratified charge combustion. It should be noted, however, that upon this switch, a predetermined transition condition must be established. If the transition condition is not established, the controller 21 continues intake stroke fuel injection.

The predetermined transition condition is established when the engine rotation speed Ne reaches a predetermined speed B, and the fuel pressure Pf in the common rail 16 reaches a predetermined pressure C, which is a fuel pressure allowing compression stroke fuel injection.

Figures 2A, 2B, 2C, 2D:
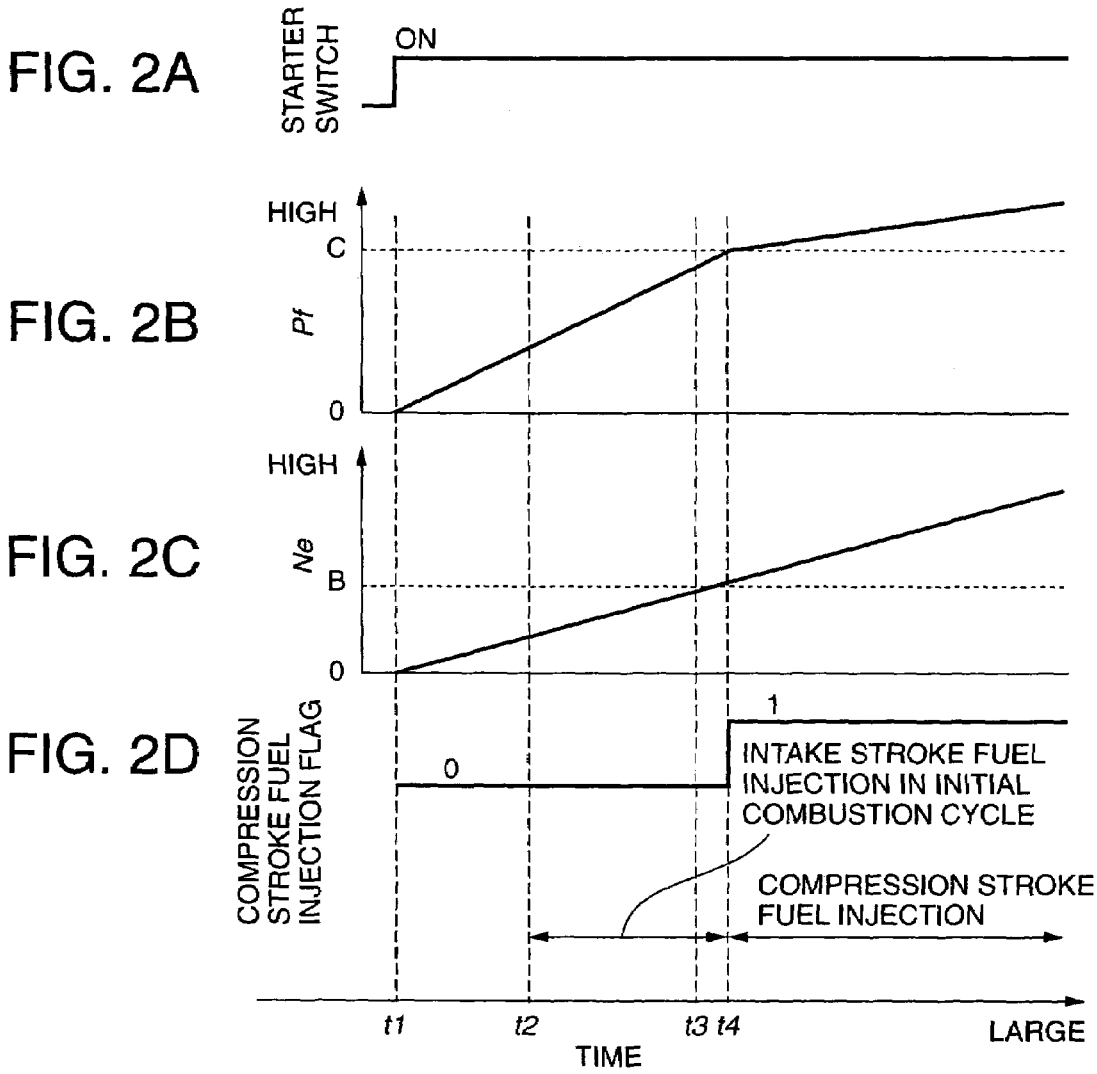
FIGS. 2A–2D are timing charts illustrating the start-up condition of the internal combustion engine during start-up fuel injection control according to this invention.

From the time t2, the engine controller 21 executes intake stroke fuel injection once in each of the cylinders #1, #3, #4, #2. At a time t3, when the first fuel injection of each cylinder #1, #3, #4, #2 is complete and the transition condition is established at a time t4, the engine controller 21 switches the fuel injection into the cylinders #1, #3, #4, #2 to compression stroke fuel injection. This switching is performed according to the setting of a compression stroke fuel injection flag, as shown in FIG. 2D.

Figure 3:
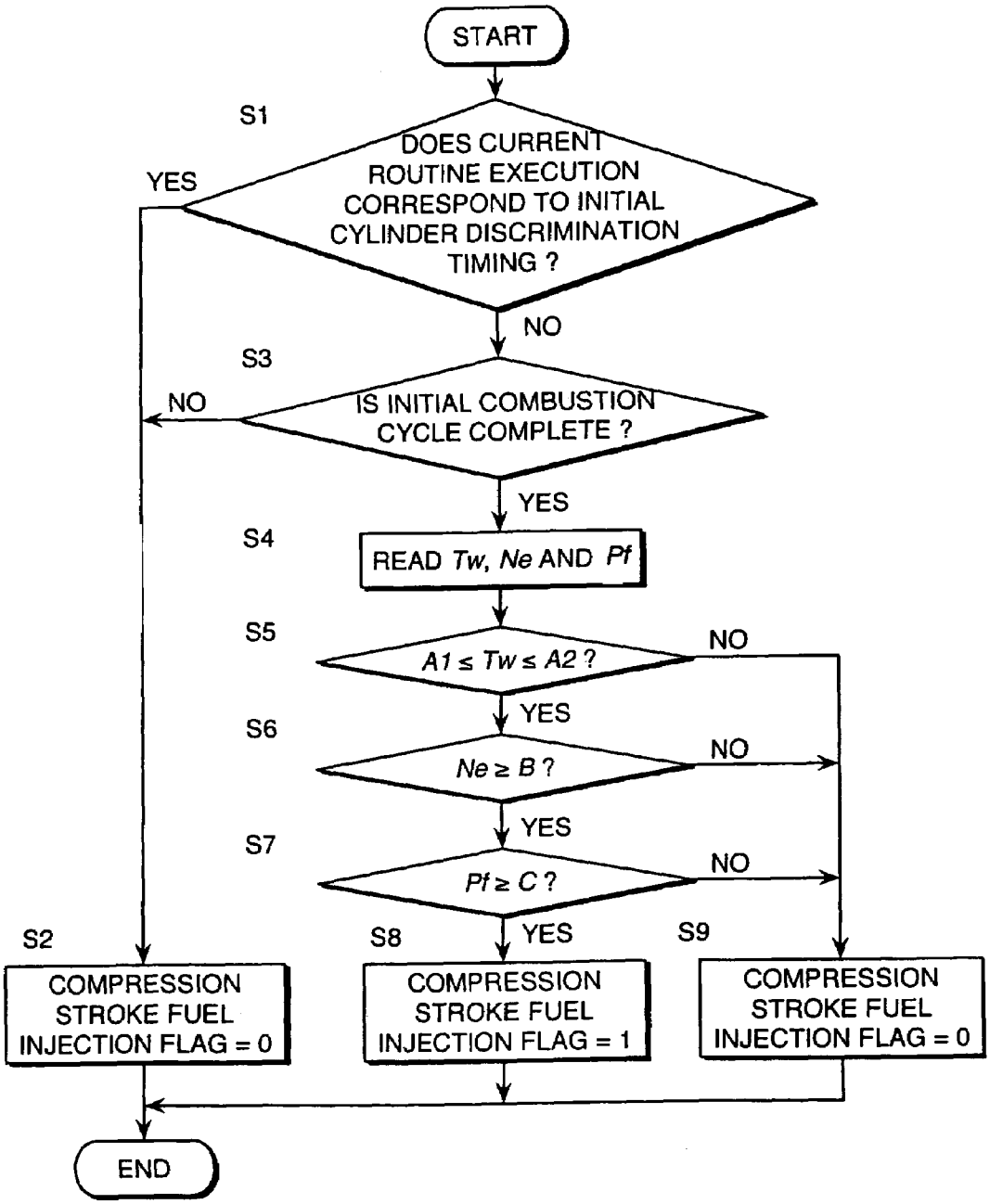
FIG. 3 is a flowchart illustrating a routine for setting a compression stroke fuel injection flag, executed by a controller according to this invention.
Figure 4:
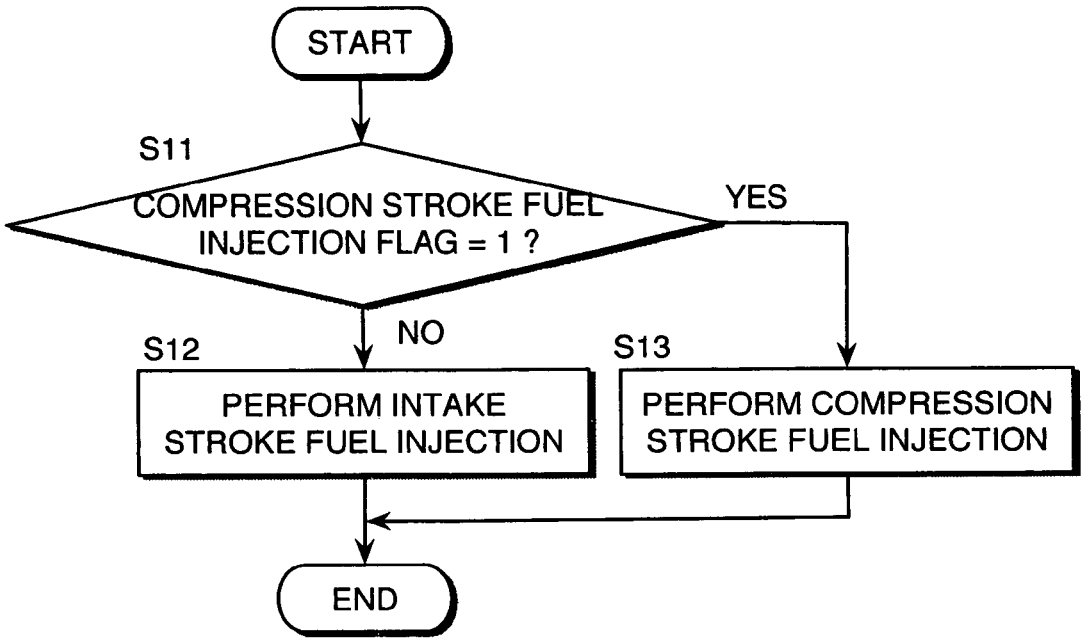
FIG. 4 is a flowchart illustrating a fuel injection control routine executed by the controller.

Referring to FIGS. 3 and 4, a routine executed by the engine controller 21 to perform the above control will be described. This routine is executed at intervals of a predetermined crank angle from the point at which a key switch provided in the vehicle switches ON to the completion of warm-up of the internal combustion engine 1. The predetermined crank angle corresponds to the combustion interval of the cylinders #1, #3, #4, #2. In the four -cylinder engine 1, this is 180 degrees.

Warm-up of the internal combustion engine 1 is determined to be complete when the engine cooling water temperature Tw exceeds a predetermined temperature. Herein the predetermined temperature is set to 80 degrees Centigrade.

First, referring to FIG. 3, in a step S1 the engine controller 21 determines on the basis of the POS signal and PHASE signal whether or not the current execution of the routine corresponds to the timing of the initial cylinder discrimination.

To describe cylinder discrimination more specifically, teeth are basically formed at ten degree crank angle intervals on a signal plate used by the position sensor 23 which outputs the POS signal. However, two teeth, which would have existed in adjacent positions at a crank angle of fifty degrees BTDC and a crank angle of fifty degrees BTDC+ten degrees of each cylinder #1, #3, #4, #2, are missing. As a result, thirty-two POS signals are generated and input into the engine controller 21 each time the crankshaft performs a single revolution, or in other words rotates 360 degrees. The term degrees BTDC signifies a crank angle before compression top dead center. No POS signal is input in the positions where a tooth is missing, and in accordance with the lack of POS signal input, the engine controller 21 generates a reference REF signal.

A signal plate used by the phase sensor 24 which outputs the PHASE signal is attached to one end of an intake camshaft. Recessed portions are formed in the positions corresponding to the aforementioned predetermined crank angles of the cylinders #1, #3, #4, #2 in a number corresponding to the cylinder number. The phase sensor 24 outputs signals corresponding to the number of recessed portions.

The engine controller 21 determines the cylinder to which the reference REF signal of the cylinders #1, #3, #4, #2 relates from the PHASE signals that are input together with the reference REF signal. This determination is referred to as cylinder discrimination.

The engine controller 21 starts the cylinder discrimination at a crank angle of 50 degrees BTDC and completes the cylinder discrimination at a crank angle of 30 degrees ATDC. Herein, the term degrees ATDC signifies a crank angle after compression top dead center. Based on the cylinder discrimination thus performed, the engine controller 21 switches the target cylinder to which fuel injection control is applied, at a crank angle of 110 degrees BTDC.

Referring back to FIG. 3, when the current routine execution corresponds to the timing of the initial cylinder discrimination in the step S1, the engine controller 21 resets the compression stroke fuel injection flag to zero in a step S2. Following the processing of the step S2, the engine controller 21 ends the routine.

If, in the step S1, the current routine execution does not correspond to the timing of the initial cylinder discrimination, the engine controller 21 determines whether or not the initial combustion cycle is complete in the step S3. This determination may be performed by setting a flag beforehand that is turned on accompanying the completion of the first intake stroke fuel injection, and determining in the step S3 whether or not the flag is ON.

When the initial combustion cycle is not complete, the engine controller 21 resets the compression stroke fuel injection flag to zero in the step S2, and then ends the routine.

When the initial combustion cycle is complete, the engine controller 21 reads the cooling water temperature Tw, the engine rotation speed Ne, and the fuel pressure Pf in the common rail 16 in a step S4.

Next, in a step S5, the engine controller 21 compares the cooling water temperature Tw to a lower limit temperature A1 and an upper limit temperature A2. The lower limit temperature A1 is set to a range of between −20 and −30 degrees Centigrade.

When the cooling water temperature Tw falls below the lower limit temperature A1, it is determined that extremely low temperature conditions apply. In extremely low temperature conditions, the friction torque of the engine 1 is large, and the engine output torque required for start-up cannot be obtained by compression stroke fuel injection. Hence, when the cooling water temperature Tw falls below the lower limit temperature A1, the engine controller 21 resets the compression stroke fuel injection flag to zero in a step S9.

The upper limit temperature A2 is a value for determining whether or not start-up of the engine 1 corresponds to a hot restart, and is set on the basis of the cooling water temperature during a hot restart. During a hot restart, unburned fuel is unlikely to be produced, and the amount of hydrocarbon (HC) discharge is small, and hence there is no need to perform compression stroke fuel injection. Accordingly, when the cooling water temperature Tw exceeds the upper limit temperature A2, the engine controller 21 likewise resets the compression stroke fuel injection flag to zero in the step S9. The upper limit temperature A2 is herein set to 70 degrees Centigrade.

When the cooling water temperature Tw is no less than the lower limit temperature A1 and no more than the upper limit temperature A2 in the step S5, the engine controller 21 determines whether or not the engine rotation speed Ne is below the predetermined rotation speed B in a step S6. The predetermined rotation speed B is a threshold for determining whether or not the rotation speed Ne of the engine 1 is rising following start-up.

The predetermined rotation speed B corresponds to the set rotation speed of the prior art that is set at a level between the cranking rotation speed and the idling rotation speed.

When the engine rotation speed Ne is less than the predetermined rotation speed B, the engine controller 21 resets the compression stroke fuel injection flag to zero in the step S9.

When the engine rotation speed Ne is equal to or greater than the predetermined rotation speed B, the engine controller 21 determines whether or not the fuel pressure Pf in the common rail 16 is below the predetermined pressure C in a step S7. The predetermined pressure C is a fuel pressure required for compression stroke fuel injection. Herein, the predetermined pressure C is set to 0.5 MPa.

When the fuel pressure Pf is less than the predetermined pressure C, the engine controller 21 resets the compression stroke fuel injection flag to zero in the step S9.

Following the processing of the step S9, the engine controller 21 ends the routine.

When the fuel pressure Pf is equal to or greater than the predetermined pressure C, the engine controller 21 sets the compression stroke fuel injection flag to unity in the step S8. Following the processing of the step S8, the engine controller 21 ends the routine.

Next, referring to FIG. 4, a fuel injection control routine executed by the engine controller 21 on the basis of the compression stroke fuel injection flag will be described. This routine is executed at intervals of a predetermined crank angle from performance of the initial cylinder discrimination to the completion of warm-up of the internal combustion engine 1.

First, in a step S11, the engine controller 21 determines whether or not the compression stroke fuel injection flag is at unity.

When the compression stroke fuel injection flag is not at unity, the engine controller 21 determines to execute intake stroke fuel injection in a step S12.

When the compression stroke fuel injection flag is at unity, the engine controller 21 determines to execute compression stroke fuel injection in a step S13.

Following the processing of the step S12 or S13, the engine controller 21 ends the routine.

Since the execution timing of the fuel injection control routine and the actual fuel injection timing differ, the engine controller 21 applies the fuel injection timing determined in the step S12 or S13 to the fuel injection that is performed directly after execution of the routine.

As described above, this invention applies homogeneous combustion by means of intake stroke fuel injection in the initial combustion cycle during start-up of the internal combustion engine 1, and once the initial combustion cycle is complete, switches to stratified charge combustion by means of compression stroke fuel injection. In so doing, the engine rotation speed directly after cranking can be raised quickly, and the discharge of unburned fuel can be suppressed, leading to a reduction in the amount of hydrocarbon (HC) discharge. Moreover, switching is performed according to the combustion cycle, and hence switching can be performed easily.

In the routine in FIG. 3, determinations are made in the steps S6 and S7 respectively as to whether or not the engine rotation speed Ne and the fuel pressure Pf are appropriate for compression stroke fuel injection. However, since the fuel pressure Pf is dependent on the engine rotation speed Ne, one of the steps S6 and S7 may be omitted.

Next, a second embodiment of this invention will be described.

This embodiment corresponds to a case in which the step S3 is omitted from the routine in FIG. 3. The constitution of the internal combustion engine 1 and the hardware constitution of the start-up fuel injection control device are identical to those of the first embodiment.

In the step S3 of the first embodiment, a determination is made as to whether or not the initial combustion cycle is complete, and in the step S2, the compression stroke fuel injection flag is set to zero until the initial combustion cycle is complete. Hence during the initial combustion cycle, intake stroke fuel injection is executed in all of the cylinders.

Conversely, in the second embodiment, where the step S3 is omitted, the compression stroke fuel injection flag is set to unity in the step S8 following the end of the initial cylinder discrimination timing as long as the results of the determinations in the steps S5–S7 do not become negative. Hence, intake stroke fuel injection is performed at the initial cylinder discrimination timing, but thereafter, compression stroke fuel injection is switched to until the determination results of the steps S5–S7 become negative.

Thus according to this embodiment, only the initial fuel injection of the cylinder which performs combustion first is performed in the intake stroke, and thereafter, fuel injection is performed in the compression stroke as long as the determination results in the steps S5–S7 do not become negative. As a result, the timing of fuel injection switching can be expedited.

The contents of Tokugan 2003-203835, with a filing date of Jul. 30, 2003 in Japan, are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

For example, in the embodiments described above, the crank angle is detected using the position sensor 23 and phase sensor 24, but the crank angle may be detected using a separate sensor.

The embodiments of this invention in which an exclusive property or privilege is claimed are defined as follows:

What is claimed is:

1. A start-up fuel injection control device for an in-cylinder fuel injection internal combustion engine which operates on a four-stroke cycle comprising an intake stroke, a compression stroke, an expansion stroke, and an exhaust stroke, the engine comprising a fuel injector which injects fuel directly into a combustion chamber, the engine performing stratified charge combustion, in which the fuel injector injects fuel in the compression stroke, and homogeneous combustion, in which the fuel injector injects fuel in the intake stroke, the device comprising:

means for controlling the fuel injector to perform fuel injection for an initial combustion in the intake stroke, and to perform fuel injection for a second combustion onward in the compression stroke.

2. A start-up fuel injection control method for an in-cylinder fuel injection internal combustion engine which operates on a four-stroke cycle comprising an intake stroke, a compression stroke, an expansion stroke, and an exhaust stroke, the engine comprising a fuel injector which injects fuel directly into a combustion chamber, the engine performing stratified charge combustion, in which the fuel injector injects fuel in the compression stroke, and homogeneous combustion, in which the fuel injector injects fuel in the intake stroke, the method comprising:

controlling the fuel injector to perform fuel injection for an initial combustion in the intake stroke, and to perform fuel injection for a second combustion onward in the compression stroke.

3. A start-up fuel injection control device for an in-cylinder fuel injection internal combustion engine which operates on a four-stroke cycle comprising an intake stroke, a compression stroke, an expansion stroke, and an exhaust stroke, the engine comprising a fuel injector which injects fuel directly into a combustion chamber, the engine performing stratified charge combustion, in which the fuel injector injects fuel in the compression stroke, and homogeneous combustion, in which the fuel injector injects fuel in the intake stroke, the device comprising:

a programmable controller programmed to control the fuel injector to perform fuel injection for an initial combustion in the intake stroke, and to perform fuel injection for a second combustion onward in the compression stroke.

4. The start-up fuel injection control device as defined in claim 3, wherein the control device further comprises a sensor which detects a rotation speed of the engine, and the controller is further programmed not to perform fuel injection for the second combustion onward in the compression stroke when the engine rotation speed is lower than a predetermined rotation speed.

5. The start-up fuel injection control device as defined in claim 3, wherein the control device further comprises a sensor which detects a fuel injection pressure of the fuel injector, and the controller is further programmed not to perform fuel injection for the second combustion onward in the compression stroke when the fuel injection pressure is lower than a predetermined pressure.

6. The start-up fuel injection control device as defined in claim 3, wherein the engine comprises a plurality of cylinders which repeat combustion in a predetermined sequence, and the controller is further programmed to control the fuel injector to perform fuel injection for the initial combustion of each cylinder in the intake stroke, and to perform fuel injection for the second combustion onward of each cylinder in the compression stroke.

7. The start-up fuel injection control device as defined in claim 6, wherein the control device further comprises a sensor for determining the stroke of each cylinder.

8. The start-up fuel injection control device as defined in claim 3, wherein the engine is a water-cooled engine, the control device further comprises a sensor which detects a cooling water temperature of the engine, and the controller is further programmed not to perform fuel injection for the second combustion onward in the compression stroke when the cooling water temperature is lower than a predetermined lower limit temperature.

9. The start-up fuel injection control device as defined in claim 8, wherein the controller is further programmed not to perform fuel injection for the second combustion onward in the compression stroke when the cooling water temperature exceeds a predetermined upper limit temperature.

10. The start-up fuel injection control device as defined in claim 3, wherein the engine comprises a plurality of cylinders which repeat combustion in a predetermined sequence, and the controller is further programmed to control the fuel injector to perform fuel injection in the intake stroke for an initial combustion of a first cylinder which performs combustion first, and to perform fuel injection in the compression stroke for the initial combustion of any cylinder other than the first cylinder.

11. The start-up fuel injection control device as defined in claim 10, wherein the control device further comprises a sensor for determining the stroke of each cylinder.

* * * * *